US005899768A

United States Patent [19]

Kameyama

[11] Patent Number: 5,899,768

[45] Date of Patent: May 4, 1999

[54] CONNECTOR GUIDE MECHANISM

[75] Inventor: Isao Kameyama, Shizuoka, Japan

[73] Assignee: Yazaki Corporation, Tokyo, Japan

[21] Appl. No.: 08/877,887

[22] Filed: Jun. 18, 1997

[30] Foreign Application Priority Data

Jun. 26, 1996 [JP] Japan ..... 8-166143

[51] Int. Cl.[6] ..... H01R 13/64

[52] U.S. Cl. ..... 439/374

[58] Field of Search ..... 439/374, 375, 439/376, 377

[56] References Cited

U.S. PATENT DOCUMENTS

Re. 34,369 9/1993 Darden et al. ..... 439/374
4,842,544 6/1989 Birch et al. ..... 439/374

FOREIGN PATENT DOCUMENTS 2-256183 10/1990 Japan .

*Primary Examiner*—Steven L. Stephan
*Assistant Examiner*—Eugene G. Byrd
*Attorney, Agent, or Firm*—Sughrue, Mion, Zinn Macpeak & Seas, PLLC

[57] ABSTRACT

A connector guide mechanism in which misregistration of two connectors with each other can be easily absorbed, and the amount of movement of the reception connector can be set to a small value. In the connector guide mechanism, a connector mounting hole is formed in a connector mounting surface, and a reception connector is mounted in the connector mounting hole, and is movable in a direction parallel to the plane of the connector mounting surface. A pair of parallel, opposed surfaces are disposed perpendicular to the connector mounting surface in such a manner that the reception connector is disposed between the opposed surfaces. An equipment-side connector is mounted on a rear surface of an equipment, and can be fitted relative to the reception connector. A pair of guide bars project rearwardly from the equipment, and the distance between distal ends of the guide bars is smaller than the distance between the opposed surfaces, and the distance between proximal ends of the guide bars is generally equal to the distance between the opposed surfaces. A guide mechanism is provided on each of the opposed surfaces and each of the guide bars so as to limit a direction of insertion of the guide bar to a direction perpendicular to the connector mounting surface.

5 Claims, 6 Drawing Sheets

CONNECTOR GUIDE MECHANISM

BACKGROUND OF THE INVENTION

1. Field of the Invention

This invention relates to a connector guide mechanism for guiding the fitting of a pair of connectors (which can be fitted together) mounted respectively on an equipment and a mounting member to which this equipment is to be attached.

2. Background

When mounting an equipment on a vehicle body, and particularly when mounting an electric equipment, such as a radio, on the vehicle body, there has, in many cases, been used a construction in which one of a pair of connectors, which can be fitted together, is mounted on the equipment while the other connector is mounted on the vehicle body, and simultaneously when attaching the equipment to the vehicle body, the two connectors are fitted together. In this case, because of dimensional tolerances of the parts, it is difficult to position or register the two connectors with each other simultaneously when mounting the equipment in position on the mounting member. Therefore, in such an equipment mounting construction, there has, in many cases, been used a construction in which one of the two connectors is movable so as to serve as a so-called reception connector so that misregistration of the connectors with each other can be absorbed.

A connector mounting hole, larger in size than a housing of the reception connector, is formed in a connector mounting surface of the mounting member, and the housing is mounted in this connector mounting hole through elastic retaining arms. Therefore, even if the two connectors are misregistered with each other, the reception connector can be moved in the connector mounting hole, for example, by abutting guide surfaces of the connectors against each other, thereby absorbing the misregistration, so that the connector on the equipment can be fitted in the reception connector.

However, in the connector fitting construction using the above reception connector, if the misregistration-absorbing range is made large, the connectors are increased in size because of increased sizes of the connector guide mechanism (including the guide surfaces, guide posts and so on), and also the connector mounting hole must be increased in size, which results in a problem that the strength of the mounting member is reduced.

If the connector mounting hole is made small in order to secure the adequate strength of the mounting member, the misregistration-absorbing range becomes small, so that the connectors can not be fitted together easily. This lowers the efficiency of the mounting operation. In addition, the connector must be moved forcibly. That is, the connector is forcibly moved or turned up and down and right and left in order to register it with the mating connector or to bring it into agreement with the mating connector which can not be viewed. Therefore, the connector interferes with other parts, so that there is a possibility that the connector, the other parts and wires are damaged.

In the connector fitting construction using the reception connector for absorbing the misregistration, the connector mounting hole must be small, and also the strength of the mounting member must be increased, and on the other hand, the function of absorbing the misregistration of the two connectors with each other must be enhanced. Thus, these contradictory effects must be achieved, and therefore the design has been difficult.

SUMMARY OF THE INVENTION

With the above problems in view, it is an object of this invention to provide a connector guide mechanism in which misregistration of two connectors with each other can be easily absorbed, and the amount of movement of the reception connector can be set to a small value, and the strength of a mounting member is increased by reducing the size of a connector mounting hole, and the efficiency of a connector fitting operation is enhanced by securing a connector misregistration-absorbing function.

The above object of the invention has been achieved by a connector guide mechanism including: a reception connector movable in a direction parallel to a plane of a connector mounting surface; a pair of parallel, opposed surfaces which are disposed perpendicular to the connector mounting surface in such a manner that the reception connector is disposed between the opposed surfaces; an equipment-side connector for fitting relative to the reception connector, the equipment-side connector being mounted on a rear surface of an equipment; a pair of guide bars projecting rearwardly from the equipment, the distance between distal ends of the guide bars being smaller than the distance between the opposed surfaces, and the distance between proximal ends of the guide bars being generally equal to the distance between the opposed surfaces; and a guide mechanism provided on each of the opposed surfaces and each of the guide bars so as to limit a direction of insertion of the guide bars to a direction perpendicular to the connector mounting surface.

Preferably, the guide mechanism includes a pair of first and second projections formed on each of the opposed surfaces, and a slit formed in each of the guide bars for fitting on the first and second projections.

In the connector guide mechanism of this construction, when mounting the equipment on a mounting member, the distal ends of the guide bars, which are spaced from each other a distance smaller than the distance between the opposed surfaces, are inserted into a space between the opposed surfaces, and therefore the insertion of the equipment can be initiated easily. As the guide bars are inserted into the space between the opposed surfaces, the gap between each guide bar and the associated one of the opposed surfaces is gradually reduced, so that the misregistration of the equipment is gradually corrected, thereby bringing the equipment-side connector into a predetermined fitting position. Accordingly, the equipment-side connector can be accurately guided to the reception connector, and the range of movement of the reception connector can be reduced.

The slit, formed in each of the guide bars, is engaged with the first and second projections formed on each of the opposed surfaces, and by doing so, the positions of the guide bars, inserted into the space between the opposed surfaces, can be easily limited.

DETAILED DESCRIPTION OF THE PREFERRED EMBODIMENT

A preferred embodiment of a connector guide mechanism of the present invention will now be described in detail with reference to the drawings.

Figure 1:
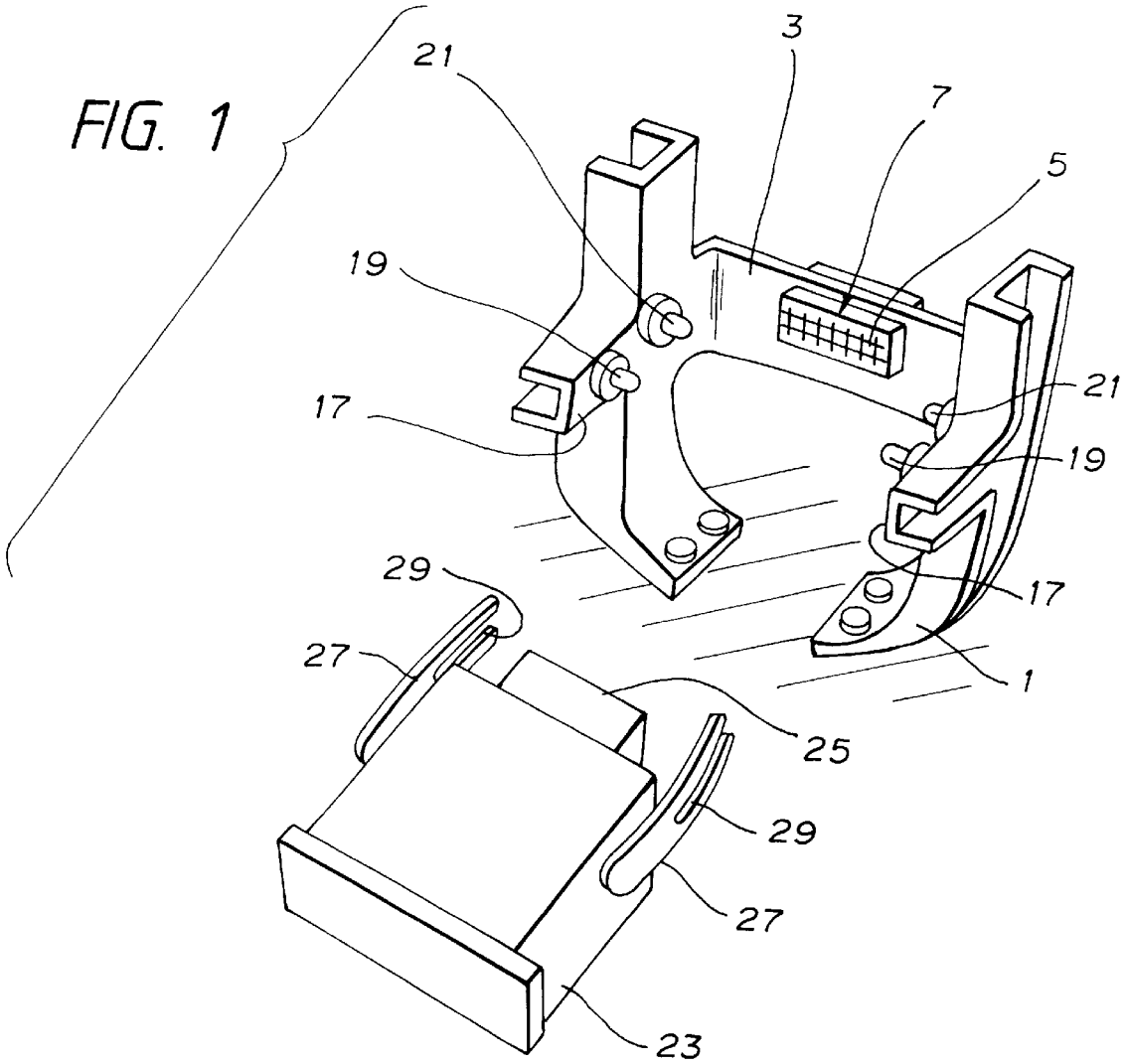
FIG. 1 is an exploded, perspective view of a connector guide mechanism of the invention before an equipment is mounted.
Figure 2:
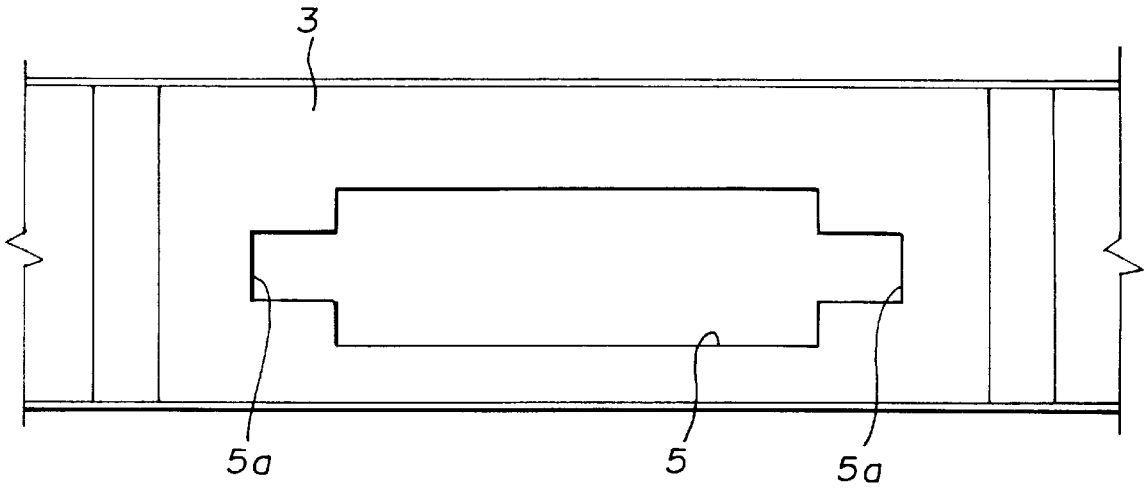
FIG. 2 is a front-elevational view showing a reception connector mounting hole.

As shown in FIGS. 1 and 2, a connector mounting hole 5, for example, of a rectangular shape, is formed in a connector mounting wall 3 of a mounting member 1. For example, the mounting member 1 is a support post of a vehicle body, etc. The size of the mounting hole 5 is larger than the outer size of a housing 9 of a reception connector 7 which is described later. In this embodiment, a pair of notches 5*a* are formed respectively in opposite ends or edges of the mounting hole 5.

Figure 3:
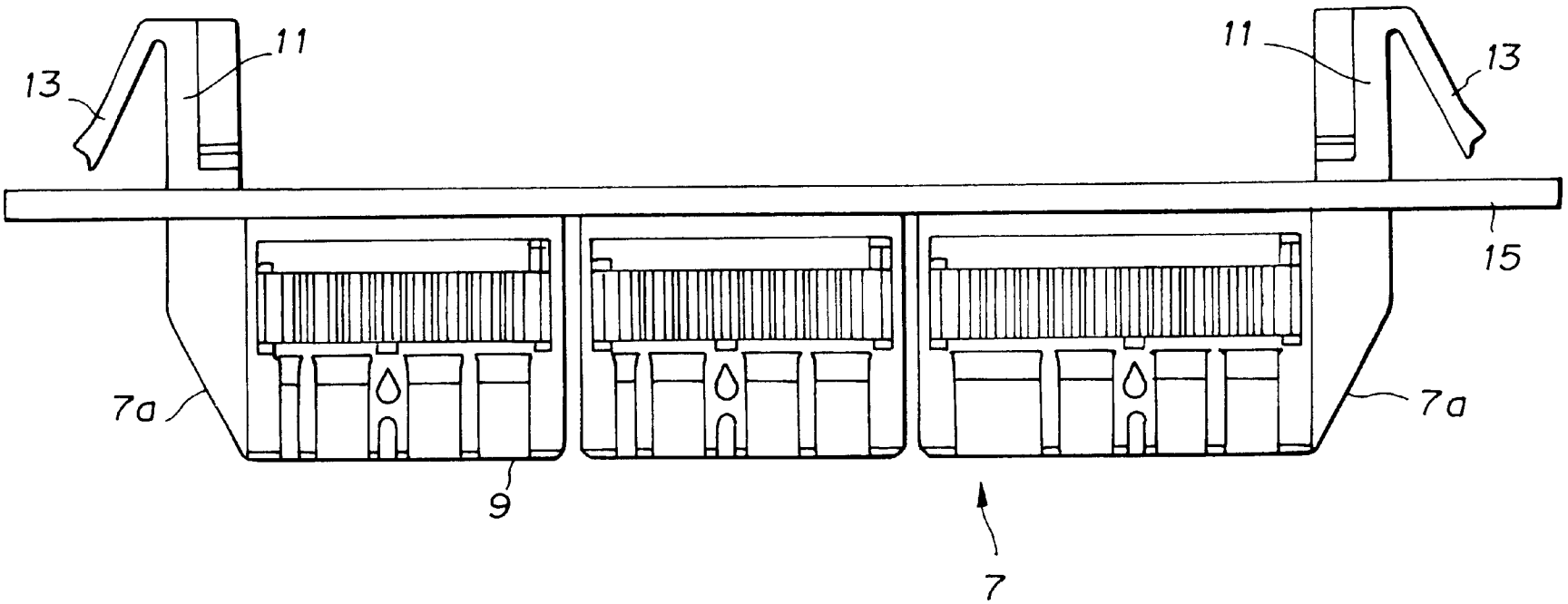
FIG. 3 is a cross-sectional view of a reception connector shown in FIG. 1.

As shown in FIG. 3, in this embodiment, the housing 9 of the reception connector 7 has a generally rectangular parallelepiped shape, and a pair of parallel surfaces of the housing 9, which are perpendicular to opposite end walls of the housing 9, serve as the front and rear sides of the connector 7, respectively. A pair of legs 11 are formed respectively on the opposite end walls of the housing 9, and project rearwardly from the connector 7. Elastic retaining pawls 13 are formed respectively at distal ends of the leges 11, and are slanting outwardly.

A flange 15 is formed at the periphery of the housing 9 in parallel relation to the rear surface thereof, and this flange 15 is adapted to abut against the front surface of the mounting wall 3. The legs 11 are passed respectively through the notches 5*a* of the mounting hole 5 from the front side of the mounting hole 5, and the flange 15 is held against the mounting wall 3, and the elastic retaining pawls 13 are retainingly engaged with the reverse surface of the mounting wall 3, thereby mounting the reception connector 7 on the mounting wall 3. In accordance with the elasticity of the elastic retaining pawls 13, the reception connector 7, mounted on the mounting wall 3, is movable in a direction parallel to the plane of the mounting wall 3 within the mounting hole 5.

As shown in FIG. 1, a pair of parallel, opposed surfaces 17 are formed integrally with the mounting wall 3 in perpendicular relation thereto in such a manner that the reception connector 7 is disposed between the opposed surfaces 17. The opposed surfaces 17 can be respectively formed, for example, by beams projecting respectively from the support post 1. A pair of first and second projections 19 and 21 are formed on and project from each of the opposed surfaces 17. The pair of first and second projections 19 and 21, formed on each of the opposed surfaces 17, are disposed on a straight line which is perpendicular to the mounting wall 3.

In this embodiment, although the pair of first and second projections 19 and 21 are formed on each of the opposed surfaces 17, the connector guide mechanism may be of such a construction that the pair of first and second projections 19 and 21 are replaced by an elongate protuberance which is formed on each of the opposed surfaces 17, and has a longitudinal axis disposed perpendicular to the mounting wall 3.

On the other hand, an equipment-side connector 25 for fitting on the reception connector 7 is mounted on a rear surface of an equipment 23. The equipment 23 has a width (that is, a dimension between its opposite side surfaces) smaller than the distance between the opposed surfaces 17. A pair of flat guide bars 27 are mounted respectively on the opposite side surfaces of the equipment 23, and extend rearwardly. A slit 29 is formed in each of the guide bars 27, and is open to a distal end of the guide bar 27.

Figure 4:
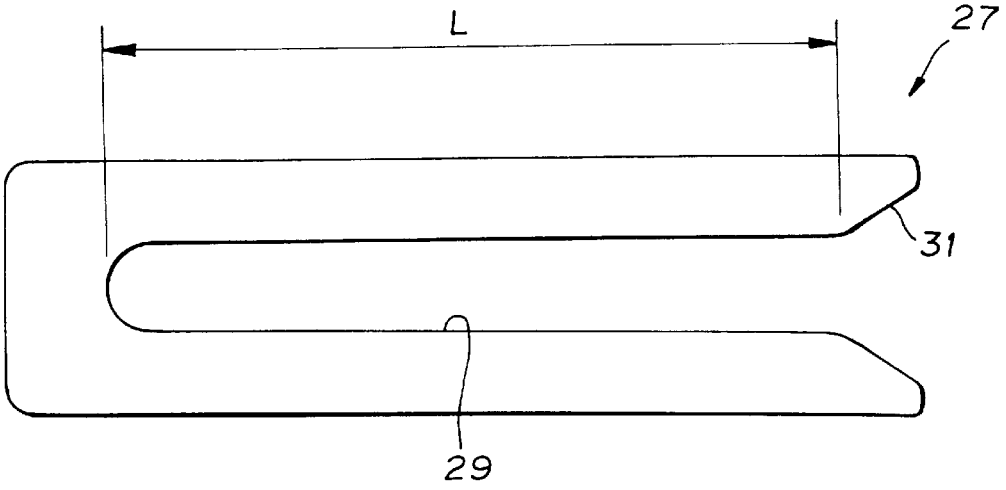
FIG. 4 is a side-elevational view of a guide bar mounted on the equipment shown in FIG. 1.

As shown in FIG. 4, a length L of the slit 29 is larger than the distance between the pair of first and second projections 19 and 21. The width of the slit 29 is generally equal to the diameter of the first and second projections 19 and 21. Therefore, when each pair of first and second projections 19 and 21 are received in the associated slit 29, the movement of the equipment 23 in upward and downward directions (upward and downward directions in FIG. 4) relative to the opposed surfaces 17 is limited. A tapering guide surface 31 is formed at a distal end portion of the guide bar 27, and spreads outwardly from the slit 29 toward the distal end of the guide bar 27. The tapering surface 31 facilitates the fitting of the first and second projections 19 and 21 into the slit 29.

The distance between the outer surfaces of the distal ends of the pair of guide bars 27 is smaller than the distance between the outer surfaces of the proximal ends of the guide bars 27. The distance between the outer surfaces of the proximal ends of the guide bars 27 is generally equal to the distance between the opposed surfaces 17. Namely, the pair of guide bars 27 are so curved that their distal ends are closer to each other.

Figure 5:
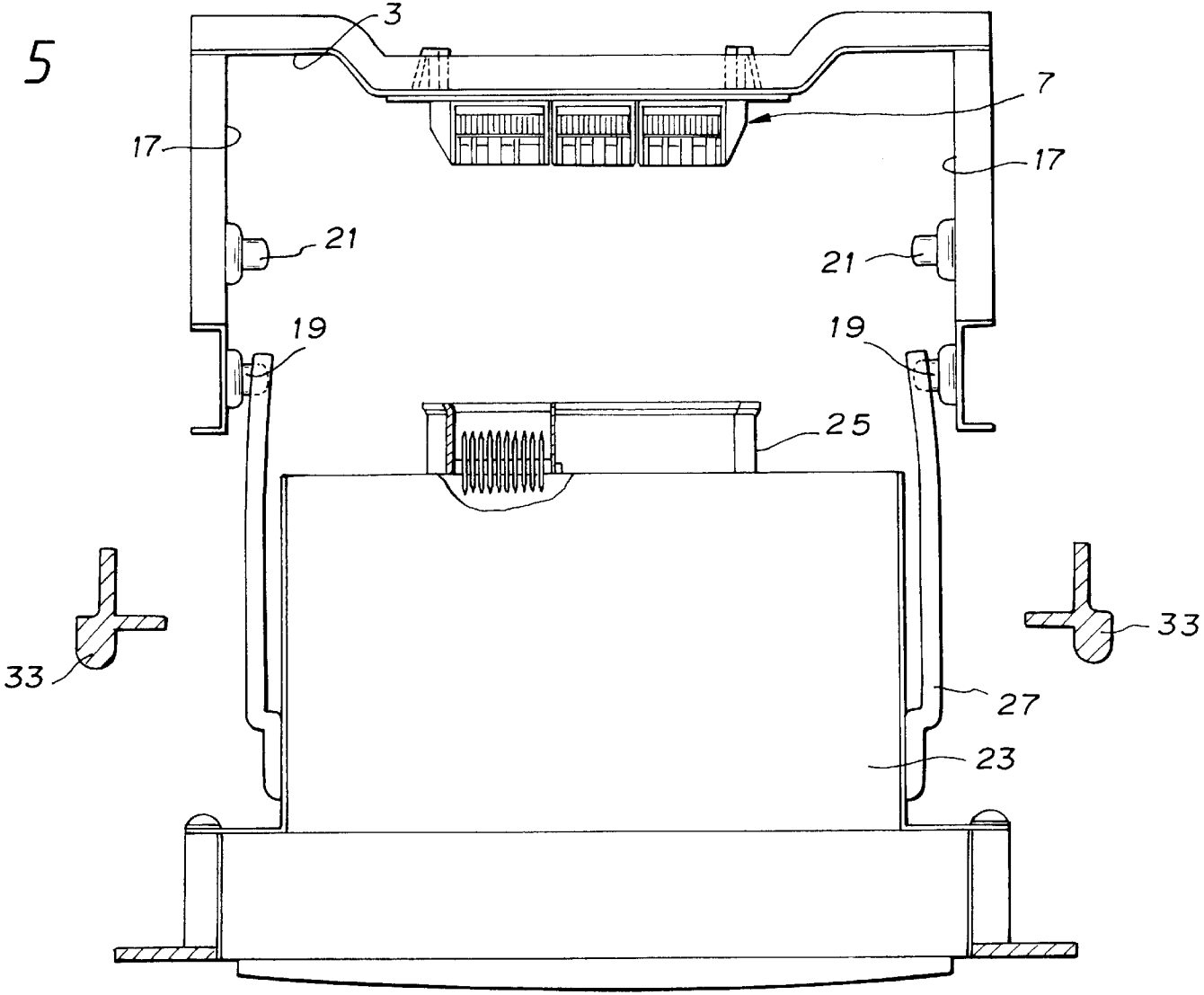
FIG. 5 is a plan view of the connector guide mechanism, showing a condition in which the guide bars are engaged with first projections, respectively.

The operation of the connector guide mechanism of this construction will now be described with reference to FIGS. 5 to 7. When fitting the equipment-side connector 25 on the reception connector 7, the distal ends of the guide bars 27 are inserted into a space between the opposed surfaces 17, and each guide bar 27 is engaged with the associated first projection 19 while sliding the tapering guide surface 31 relative to the first projection 19.

At this time, since the distance between the outer surfaces of the distal ends of the pair of the guide bars 27 is smaller than the distance between the opposed surfaces 17, the guide bars 27 can be easily inserted into the space between the opposed surfaces 17. Since the tapering guide surface 31 slides relative to the first projection 19, the fitting of the first projection 19 into the slit 29 can be effected easily.

Then, in a condition in which the first projections 19 are engaged respectively in the slits 29, the equipment 23 is further inserted toward the reception connector 7. At this time, since the pair of first projections 19 have already been engaged respectively with the guide bars 27, the equipment 23 is inserted in such a manner that the upward and downward movement of the equipment 23 is limited to a certain degree, and therefore a large misregistration of the equipment 23 relative to the reception connector 7 will not occur.

Figure 6:
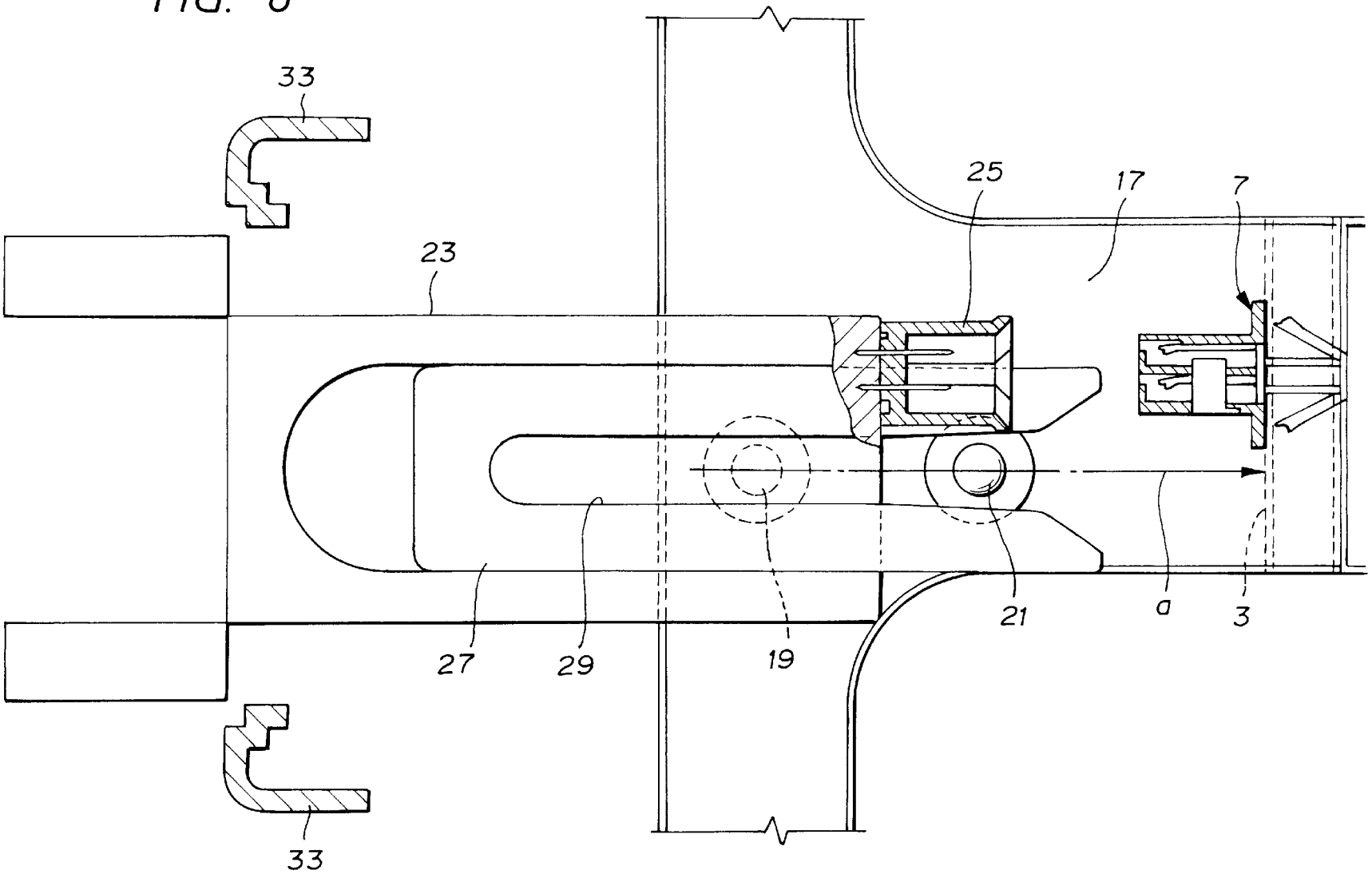
FIG. 6 is a partly-broken, side-elevational view of the connector guide mechanism, showing a condition in which each guide bar is engaged with the first and second projections.
Figure 7:
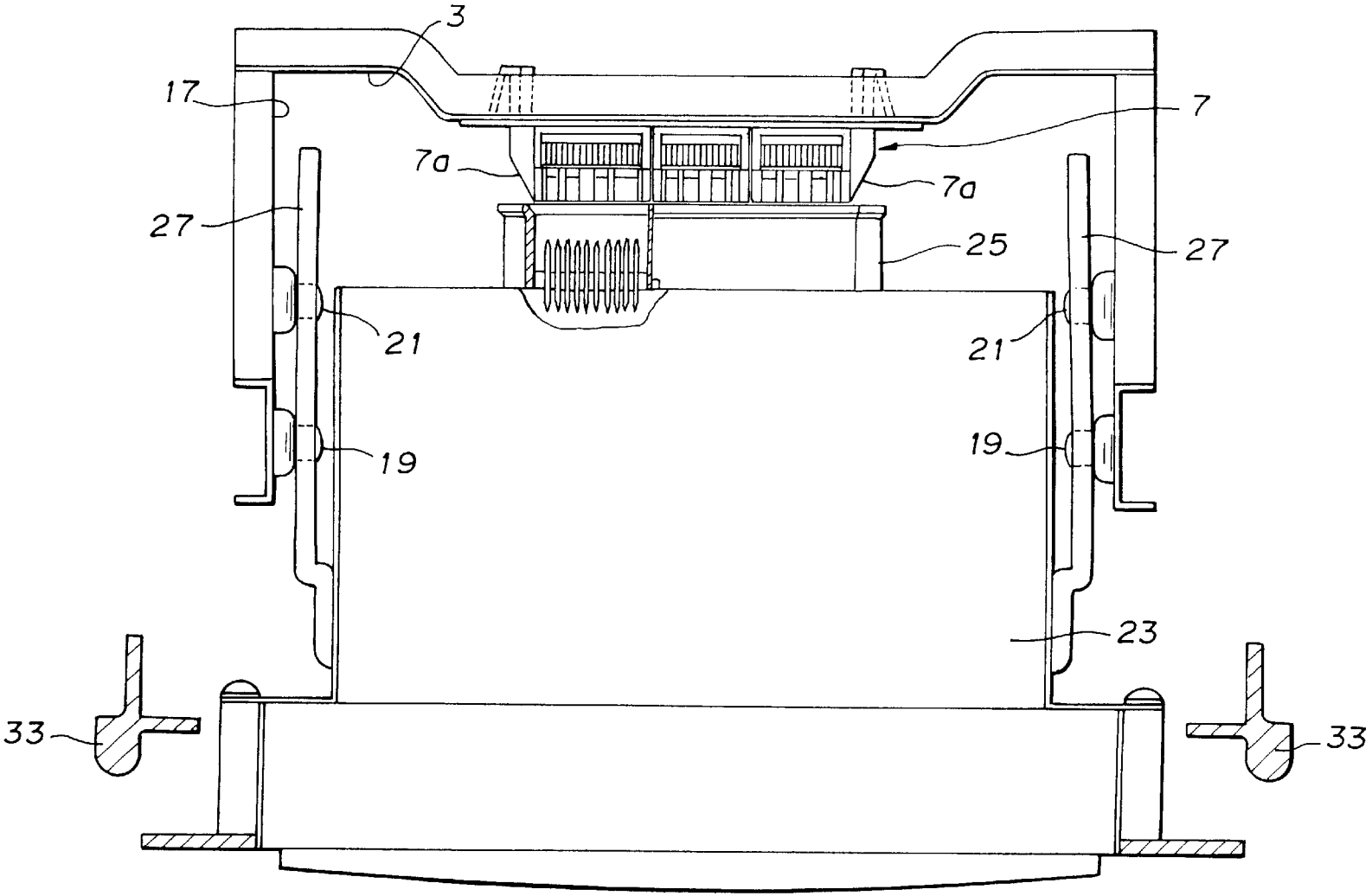
FIG. 7 is a plan view of the connector guide mechanism, showing a condition in which each guide bar is engaged with the first and second projections.

When the equipment 23 is further inserted, as shown in FIGS. 6 and 7, the second projections 21 are engaged respectively with the distal ends of the guide bars 27, and therefore each pair of first and second projections 19 and 21 are engaged with the associated guide bar 27. When the slit 29 is fitted on the pair of first and second projections 19 and 21, the direction of insertion of the equipment 23 is limited to a predetermined direction. For example, this predetermined direction is a direction indicated by arrow a in FIG. 6, and is a direction of a straight line passing through the pair of first and second projections 19 and 21, that is, a direction perpendicular to the mounting wall 3.

In this condition, those portions of the guide bars 27, which are spaced from each other a distance generally equal to the distance between the opposed surfaces 17, are disposed between the first projections 19, so that the movement of the equipment 23 toward and away from the opposed surfaces 17 is almost limited (that is, the equipment 23 may not shake). Accordingly, the movement of the equipment 23 relative to the reception connector 7 in a direction parallel to the plane of the mounting wall 3 is limited, and the equipment-side connector 25 is positioned substantially in registry with the reception connector 7.

In this condition, when the equipment 23 is further inserted, the equipment-side connector 25 begins to be fitted on the reception connector 7 is first moved so as to absorb misregistration through guide surfaces 7*a*, and then is completely fitted into the equipment-side connector 25. After the equipment-side connector 25 and the reception connector 7 are thus fitted together, the equipment 23 is fixedly secured by screws or the like to an outer panel (such as an instrument panel) 33 mounted on the front side of the support posts 1, thus completing the mounting of the equipment 23.

In the above connector guide mechanism, there are provided the pair of opposed surfaces 17 perpendicular to the mounting wall 3, and the first and second projections 19 and 21 are formed on each of the opposed surfaces 17, and the equipment 23 is provided with the pair of guide bars 27 each having the slit 29 for engagement with the first and second projections 19 and 21, and the distance between the distal ends of the guide bars 27 is smaller than the distance between the opposed surfaces 17. With this construction, at the initial stage of the mounting of the equipment 23, a large misregistration can be absorbed, and as the insertion of the equipment 23 proceeds, the gap between the outer surface of each guide bar 27 and the associated surface 17 is reduced, thereby gradually correcting the misregistration of the equipment 23, so that the equipment-side connector 25 can be brought into the predetermined fitting position.

Therefore, the equipment-side connector 25 can be guided accurately to the reception connector 7, and the range of movement of the reception connector 7 can be reduced.

Therefore, the efficiency of the mounting operation can be enhanced, and besides the size of the mounting hole 5 in the reception connector 7 can be reduced, so that the strength of the mounting wall 3 (that is, the strength of the support posts 1) is prevented from being reduced.

From the beginning of the mounting operation, the insertion of the equipment 23 can be guided by the guide bars 27, and therefore when fitting the two connectors together, the connector will not be forcibly moved or turned so as to bring the two connectors into agreement with each other, and the connectors and other parts will not be damaged by interference.

Further, in the conventional mounting construction in which the connector can not be viewed, the sixth sense and skill of the operator might be required. However, by the use of the above connector guide mechanism, the guide bars 27 can be engaged respectively with the first projections 19 at the beginning of the mounting operation, while viewing these portions with the eyes, and therefore the mounting operation may carry out without the need for any skill.

In the above embodiment, although the first and second projections 19 and 21 are formed on each of the opposed surfaces 17 while the slit 29 is formed in each guide bar 27, there can be used an arrangement in which the slit 29 is formed in each of the opposed surfaces 17 while the first and second projections 19 and 21 are formed on each guide bar 27, and in this case, also, the same effects as described above can be achieved.

As described above in detail, in the connector guide mechanism of the invention, the guide bars project from the equipment, and the distance between the distal ends of the guide bars is smaller than the distance between the opposed surfaces, and the distance between the proximal ends of the guide bars is generally equal to the distance between the opposed surfaces, and the guide mechanism for limiting the direction of insertion of the guide bar is provided on each guide bar and each of the opposed surfaces. With this construction, at the initial stage of the mounting of the equipment, a large misregistration can be absorbed, and as the equipment is inserted, the misregistration of the equipment is gradually corrected, so that the equipment-side connector can be brought into the predetermined fitting position. Accordingly, the equipment-side connector can be accurately guided to the reception connector, and the range of movement of the reception connector can be reduced, and the size of the connector mounting hole can be reduced, so that the strength of the mounting member can be prevented from being reduced.

The slit is formed in each of the guide bars, and the first and second projections for fitting in the slit are formed on each of the opposed surfaces, and by doing so, the guide mechanism for limiting the direction of insertion of the guide bars can be easily provided.

What is claimed is:

1. A connector guide mechanism, comprising:

a mounting member including a connector mounting wall which has a connector mounting hole, and a pair of opposed wall portions which are disposed on said connector mounting wall;

a reception connector movably mounted in said connector mounting hole;

an equipment-side connector, for fitting to said reception connector, mounted on an equipment;

a pair of guide bars projecting from said equipment, a distance between distal ends of said guide bars being smaller than a distance between said opposed wall portions, and a distance between proximal ends of said guide bars being generally equal to the distance between said opposed wall portions, wherein said equipment-side connector is fittable to said reception connector as said guide bars are inserted into a space between said opposed wall portions; and guide means for limiting a direction of insertion of said guide bars between said opposed wall portions to a direction perpendicular to said connector mounting wall, said guide means provided at each of said opposed wall portions and each of said guide bars.

2. The connector guide mechanism of claim 1, wherein said guide means includes a pair of first and second projections formed on each of said opposed wall portions, and a slit formed in each of said guide bars for engaging with said first and second projections.

3. The connector guide mechanism of claim 2, wherein each of said opposed wall portions includes boss portions formed thereon, and wherein said first and second projections are formed on said boss portions, respectively.

4. A connector guide mechanism, comprising:

a connector mounting surface with a pair of parallel walls extending therefrom, said pair of parallel walls being spaced apart from each other a predetermined distance;

a reception connector movably mounted on said connector mounting surface between said pair of parallel walls;

an equipment-side connector for coupling to said reception connector, said equipment-side connector being mounted on an equipment;

a pair of guide bars projecting from said equipment, said pair of guide bars having (1) distal ends which are spaced apart a distance which is less than said predetermined distance between said pair of parallel walls, and (2) proximal ends which are spaced apart a distance which is substantially equal to said predetermined distance between said pair of parallel walls, such that, during an insertion of said guide bars between said pair of parallel walls, said parallel walls increasingly limit a play movement of said pair of guide bars back and forth between said pair of parallel walls; and guide means provided on each of said pair of parallel walls and each of said pair of guide bars to limit a movement of said pair of guide bars in a direction which is perpendicular to a direction of said play movement.

5. The connector guide mechanism of claim 4, in which said guide means includes a first projection and a second projection formed on each of said pair of parallel walls, and a slit formed in each of said pair of guide bars for receiving said first and said second projections.

* * * * *